US010364611B2

(12) United States Patent
Lubberger et al.

(10) Patent No.: US 10,364,611 B2
(45) Date of Patent: Jul. 30, 2019

(54) DRILL HEAD FOR EXPANDING A PILOT BORE IN ORDER TO CREATE A BOREHOLE

(71) Applicant: HERRENKNECHT AG, Schwanau (DE)

(72) Inventors: Michael Lubberger, Schwanau (DE); Tobias Gerhardt, Teningen (DE)

(73) Assignee: Herrenknecht, Schwanau (DE)

( * ) Notice: Subject to any disclaimer, the term of this patent is extended or adjusted under 35 U.S.C. 154(b) by 344 days.

(21) Appl. No.: 14/911,956

(22) PCT Filed: Aug. 8, 2014

(86) PCT No.: PCT/EP2014/002179

§ 371 (c)(1),
(2) Date: Jul. 3, 2016

(87) PCT Pub. No.: WO2015/022065

PCT Pub. Date: Feb. 19, 2015

(65) Prior Publication Data

US 2016/0305189 A1 Oct. 20, 2016

(30) Foreign Application Priority Data

Aug. 15, 2013 (DE) ..... 10 2013 013 477

(51) Int. Cl.

| | |
|---|---|
| ***E21B 10/28*** | (2006.01) |
| ***E21B 7/28*** | (2006.01) |
| *E21B 7/04* | (2006.01) |
| *E21B 10/60* | (2006.01) |
| *E21B 17/10* | (2006.01) |

(52) U.S. Cl.

CPC ..... *E21B 10/28* (2013.01); *E21B 7/28* (2013.01); *E21B 7/046* (2013.01); *E21B 10/60* (2013.01); *E21B 17/1078* (2013.01)

(58) Field of Classification Search

CPC ..... E21B 7/28; E21B 10/28

See application file for complete search history.

(56) References Cited

U.S. PATENT DOCUMENTS

| | | | |
|---|---|---|---|
| 1,874,066 | A | 8/1932 | Bettis |
| 2,882,019 | A | 4/1959 | Carr |

(Continued)

FOREIGN PATENT DOCUMENTS

| | | | |
|---|---|---|---|
| EP | 0360321 | A1 | 3/1990 |
| GB | 2490529 | A | 11/2001 |
| WO | 02/31313 | A1 | 4/2002 |

*Primary Examiner* — Kristyn A Hall

(74) *Attorney, Agent, or Firm* — Mark Rodgers

(57) ABSTRACT

A drill head for expanding a pilot bore in order to create a borehole having a borehole wall as a result of loosening rock surrounding the pilot bore in the region of a working face, which extends in a substantially right-angled manner to the pilot bore, including a basic body including a connection element for a pilot bore string including at least two tool holders, in that at least one tool holder is at a greater spacing radially from the basic body than the at least one other tool holder such that there is at least one outer and one inner drilling tool which are movable into engagement with the working face, and the at least one inner drilling tool and the at least one outer drilling tool are each arranged offset at an angle in relation to the working face.

14 Claims, 8 Drawing Sheets

(56) References Cited

U.S. PATENT DOCUMENTS

| | | | | |
|---|---|---|---|---|
| 3,126,066 | A | 3/1964 | Williams | |
| 3,384,191 | A | 5/1968 | Justman | |
| 3,750,767 | A | 8/1973 | Pessier | |
| 4,105,083 | A | 8/1978 | Allen | |
| 4,125,167 | A | 11/1978 | Evans | |
| 4,706,748 | A | 11/1987 | Harris | |
| 5,269,384 | A | 12/1993 | Cherrington | |
| 2010/0078223 | A1* | 4/2010 | Buske | C22C 1/051 175/325.5 |
| 2010/0181115 | A1 | 7/2010 | Eddison | |
| 2010/0252326 | A1 | 10/2010 | Bhome et al. | |
| 2011/0079443 | A1 | 4/2011 | Buske | |
| 2014/0338979 | A1* | 11/2014 | Gunsaulis | E21B 10/28 175/57 |
| 2014/0338984 | A1 | 11/2014 | Maher | |

* cited by examiner

DRILL HEAD FOR EXPANDING A PILOT BORE IN ORDER TO CREATE A BOREHOLE

CROSS-REFERENCE TO RELATED APPLICATIONS

This Application claims priority to International Application PCT/EP2014/002179 filed 8 Aug. 2014 which in turn claims priority to German Application DE 10 2013 013 477.3 filed 15 Aug. 2013, both of which are incorporated by reference in their entirety

BACKGROUND

The invention relates to a drill head for expanding a pilot bore in order to create a borehole having a borehole wall as a result of loosening rock surrounding the pilot bore in the region of a working face, which extends in a substantially right-angled manner to the pilot bore, and having a basic body, on which a connection element for a pilot bore string is provided, wherein at least one tool holder for at least one drilling tool is provided on the basic body.

DESCRIPTION OF RELATED ART

EP 0 360 321 discloses a so-called HDD method (Horizontal Directional Drilling) where for the trenchless installation of a pipeline underneath an obstruction along a predefined bore line, a pilot bore is created from a launch point to a target point. A reamer, which is connected to the pipeline to be installed, is then mounted on the pilot bore string on the target side. The reamer is driven as a result of rotating the pilot string. The reamer is advanced and the pipeline simultaneously pulled in as a result of extracting the pilot bore string. The reamer is realized in this case such that it is closed on the connection side to the pipeline. Only a discharge line for removing the loosened soil in connection with a suspension for lubricating the pipeline, for holding open the borehole and for removing the drill cuttings is provided in the pipeline. The reamer is open on the front side such that soil loosened by the reamer is able to enter the reamer and is able to be removed there mixed with water. The reamer itself provides a cylindrical body which on its front side comprises teeth by means of which the soil is loosened. U.S. Pat. No. 5,269,384 discloses a method and a device for expanding a borehole. A pilot bore, as also by means of an HDD bore, is produced in this connection. A reamer is then mounted on the pilot bore string. A pipeline which corresponds substantially to the diameter of the pilot bore string is provided behind the reamer.

It has been shown in practice that when the HDD method is used, the expansion drill heads are subject to enormous wear. This is the case, in particular, when a so-called single-pass method is used where the pilot borehole is expanded to the end diameter of the borehole to be produced. The wear is effected essentially on the roller bits/cutting rollers. If these are worn prior to reaching the end point, the expansion drill head has to be removed from the borehole and the roller bits changed and then the expansion drill head is introduced into the borehole again in order to be able to continue drilling. This results in considerable set-up times.

It has been shown that different aspects are responsible for the wear.

First and foremost is the centering of the drill head in the borehole or in the pilot hole. Bad centering has a negative effect on the service life of the cutter (cutting rollers) and the bearings and hard metal inserts thereof. In addition, insufficient centering leads to vibrations and oscillations which continue over the drill pipes up to the connected drilling instrument. Bad centering in the borehole additionally results in non-round boreholes along the route to be drilled. Where there are several of the expansion passages, this influences the wear on the next passage.

In addition, wear occurs as a result of large drill cuttings being deposited directly behind the drill head on the bottom of the borehole and not being flushed to the outlet opening of the bore by means of the introduced suspension. These remain there on the bottom in a type of bed and are only repeatedly traveled over and further crushed as a result of the expansion drill head moving out of the bore/into the bore. Up to now, this problem has either been ignored or it has resulted in the borehole diameter being over-dimensioned in order to create space for the entry of the product pipeline which is introduced into the borehole. The wear results in general in the intervals for replacing the rollers becoming shorter. In addition, it results initially in the loss of the caliber series carbide inserts of the of the cutting roller, which, in turn, leads to a smaller borehole.

SUMMARY

It is consequently the object of the invention to provide a drill head where the wear on the cutting rollers is reduced.

According to the invention, a first solution to the object provides that at least two tool holders are provided, that at least one tool holder is at a greater spacing radially from the basic body than the at least one other tool holder such that there is present at least one outer and one inner drilling tool which are movable into engagement with the working face, and that the at least one inner drilling tool and the at least one outer drilling tool are each arranged offset at an angle in relation to the working face.

It has been shown in a surprising manner that as a result of the angular arrangement of the drilling tools with respect to one another, the drill head is centered in an optimum manner in relation to the working face such that there is a clear reduction in wear.

A preferred teaching of the invention provides that the two drilling tools are arranged such that the working face comprises at least one radially circumferential wedge-like recess or at least one radially circumferential wedge-like projection. It is advantageous in this case for the inside angle between the drilling tools to be between 120 and 150°, in a preferred manner between 135 and 140°.

According to the invention, a second solution to the object provides that a flushing nozzle is provided from which a flushing medium can be output, wherein the flushing nozzle is arranged such that the region between the borehole wall and the outer portion of the drilling tool pointing to the borehole wall is flushable with the output flushing medium.

It has been shown in a surprising manner that the wear can be considerably reduced in a simple manner as a result of targeted flushing of the gap in the caliber range between the borehole wall and the cutting rollers.

According to the invention, a third solution to the object provides that there is provided at least one receiving tool which comprises a region for engaging with the working face, on which region a drilling tool is arranged, and that the receiving tool receives the drill cuttings loosened at the working face and removes them from the drilling region.

Here too, it has been shown in a surprising manner that the wear is clearly reduced as a result of directly receiving the drill cuttings at the working face. In addition, a reduction in wear occurs at the cutting rollers because as a result of providing a separate drilling tool on the receiving tool, the part-loosened rock possibly located at the working face or the loose rock which is also present is loosened by the additional drilling tool and does not have to be loosened and crushed further by the cutting rollers, which also results in wear on the cutting rollers.

A preferred teaching of the invention provides that at least one flushing nozzle is provided on the receiving tool. This improves the removal of the drill cuttings and supports the loosening of part-loosened rock or loose rock that is also present.

In addition, it is advantageous that the receiving tool and/or the drilling tool comprises the form of the surface contour of the working face. A further teaching of the invention provides that the receiving tool covers the drilling region of the drill head in a radial manner. A particularly thorough removal is ensured as a result.

According to the invention, a fourth solution to the object provides that there is provided a crushing tool for crushing the drill cuttings which comprises a crushing surface which is movable along the borehole wall such that a crushing gap is provided between the crushing surface and the borehole wall.

The provision of such a crushing tool directly on the drill head causes the drill cuttings to be discharged in a better manner. Loosened large diameter drill cuttings are, where applicable, harder to discharge by means of the flow of the flushing medium flowing in the borehole and tend to be deposited on the borehole bottom. A breaking tool has only been used up to now in the case of discharge by means of a pipeline provided for this purpose, for example in the case of micro-tunneling or similar methods. Such additional breaking has not been possible up to now in the case of HDD methods.

A preferred teaching of the invention provides that the crushing gap is adjustable. As a result, it is possible to take into consideration the maximum grain size of the discharge in dependence on the flushing medium.

In addition, it is advantageous that the crushing surface is arranged at an angle in relation to the borehole wall. A particularly good crushing result is achieved in this way.

A further teaching of the invention provides that the crushing tool is arranged on an outside surface of a receiving tool. This provides an efficient arrangement option for the tool without additional elements on the drill head.

According to the invention, a fifth solution to the object provides that at least one receiving tool is provided for receiving drill cuttings which are located on the bottom of the borehole and comprises a receiving surface which is at an angle of <20° in relation to the alignment line of the borehole.

It has been shown in a surprising manner that a particularly effective removal of the drill cuttings is possible as a result. As a result of the flat angle, the drill cuttings are not shoveled behind the drill head, but are entrained along the circumference of the borehole and on account of gravity fall down from the highest point of the borehole and from there pass directly into the stream of flushing medium.

A preferred teaching of the invention provides that the receiving surface is provided on its radial outside surface with a centering surface and/or a crushing surface.

According to the invention, a sixth solution to the object provides that the tool holder is arranged such that it is radially adjustable.

It has been shown in a surprising manner that as a result the wear on the outer cutting rollers can be considerably reduced. The effect of the adjustment is that, when re-installed, after replacement on the path to the working face, a new drilling tool does not have to work excessively especially within the caliber range as the diameter does not have to be expanded in the region processed by the worn cutting rollers in order to enable the diameter for inserting the drill head with the new cutting rollers.

A preferred teaching of the invention provides that spacers are provided for providing the adjustability. This provides a particularly simple option for adjustment.

Said six previously named solutions to the object according to the invention can be combined with one another in an advantageous manner to reduce wear.

A further teaching of the invention provides that at least one centering element that is active in relation to the borehole wall is present on the side of the drill head remote from the working face. Further improvement of the stabilizing of the drill head can be achieved as a result.

A further teaching of the invention provides that the connection element is realized in an elongated manner with respect to the entry into the pilot bore and/or is realized substantially with a diameter of the pilot bore stand and/or comprises a centering portion with a diameter which is substantially identical to the diameter of the pilot bore. Further improvement of the stabilizing of the drill head can be achieved in a simple manner as a result.

A further teaching of the invention provides that at least one stabilizing element is provided which comprises on its outside surface a contact portion, flat or with the radius of the borehole wall, and that the stabilizing element is realized in a preferred manner as a receiving tool. Further improvement of the stabilizing of the drill head can be achieved in a simple manner as a result.

A further teaching of the invention provides that a centering element which is described below is provided behind the drill head.

According to the invention, a further solution to the object provides that a centering element is arranged behind a drill head, in particular a drill head of the previously described realization, having a basic body which comprises connection elements for mounting the centering element in a drill string, wherein portions are provided on the basic body realized in the manner of circular segments arranged on the basic body by means of at least one support element and which coincide with the bore radius of the drill head, wherein at least one portion comprises a receiving tool for receiving drill cuttings located on the bottom of the borehole, which comprises a receiving surface which is at an angle of <20° in relation to the alignment line of the borehole.

The drill string behind the drill head is stabilized as a result of providing the centering element, which has a positive effect on the centering of the drill head in relation to the working face. In addition, as a result of the targeted discharge of the drill cuttings deposited where applicable on the bottom of the borehole, the renewed overrunning by the drill head and the wear consequently associated therewith are avoided.

A further teaching of the invention provides that the receiving surface is provided on its radial outside surface in a preferred manner with a centering surface and/or a crushing surface.

It must be added that the wording "and/or" is understood both as an "and" link and as an "or" link to the corresponding feature.

BRIEF DESCRIPTION OF THE SEVERAL VIEWS OF THE DRAWINGS

The solutions to the inventions are described in more detail below by way of a preferred exemplary embodiment in conjunction with a further drawing, in which.

DETAILED DESCRIPTION

Figure 1:
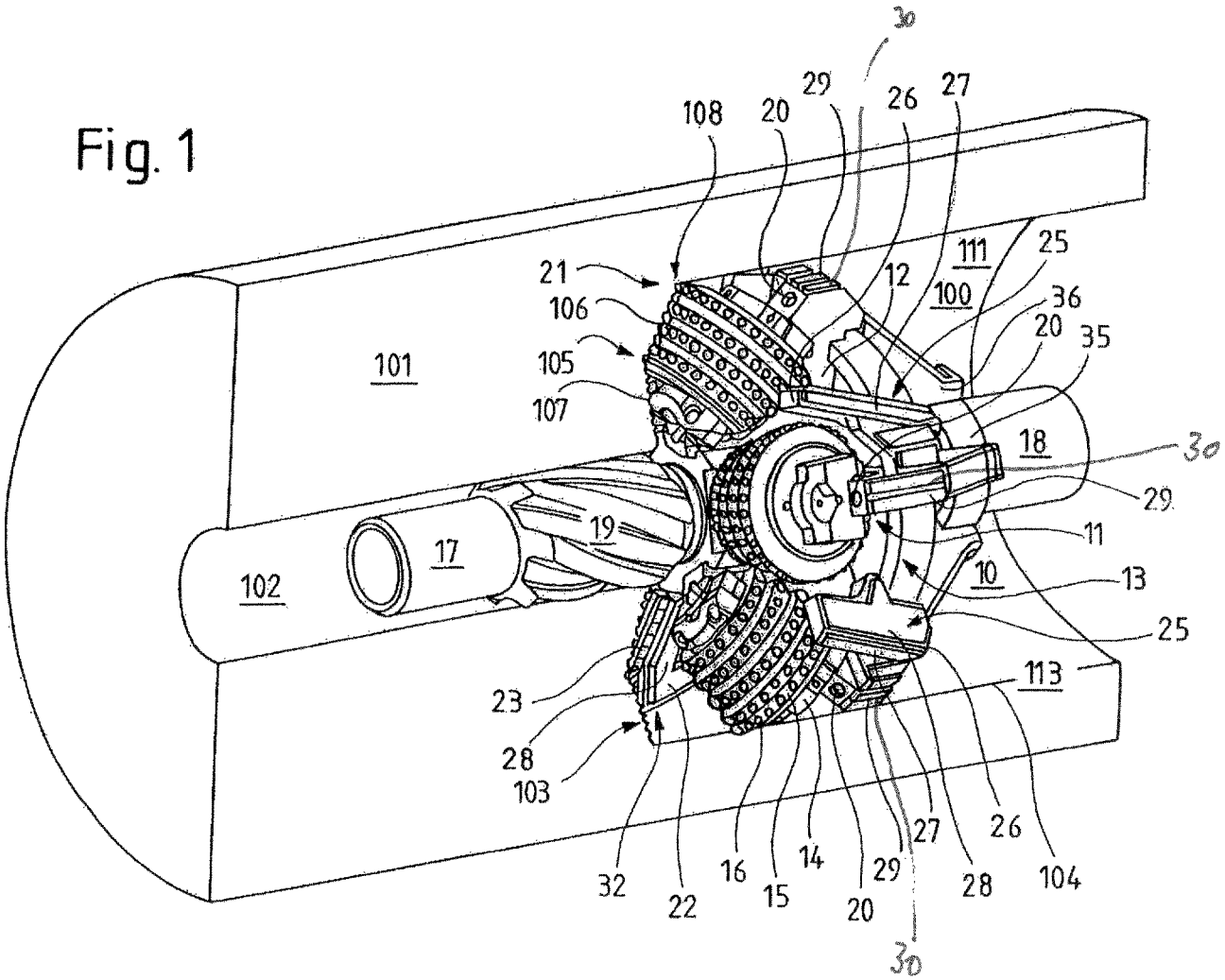
FIG. 1 shows a first three-dimensional view of a drill head according to the invention in a borehole.
Figure 2:
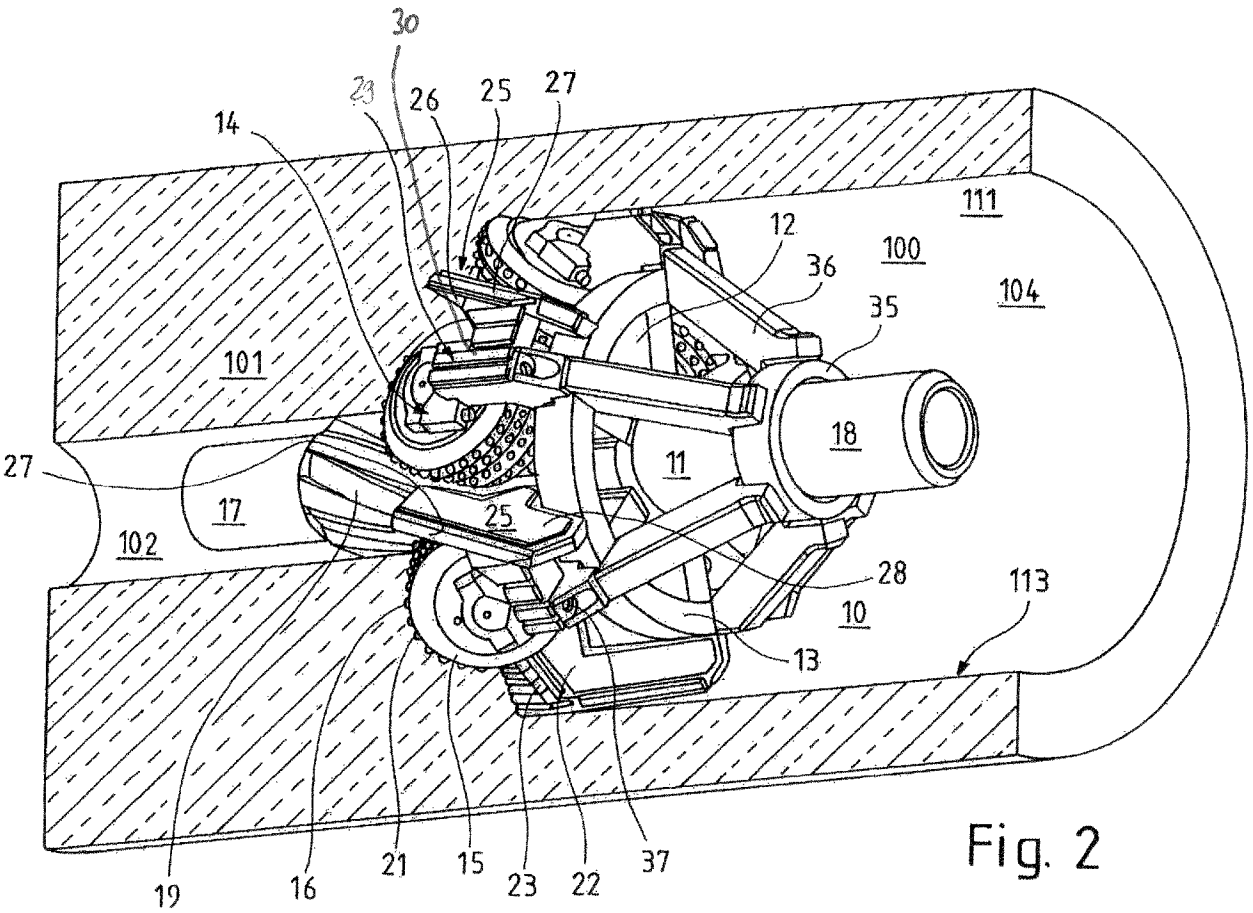
FIG. 2 shows a second three-dimensional view of FIG. 1.
Figure 3:
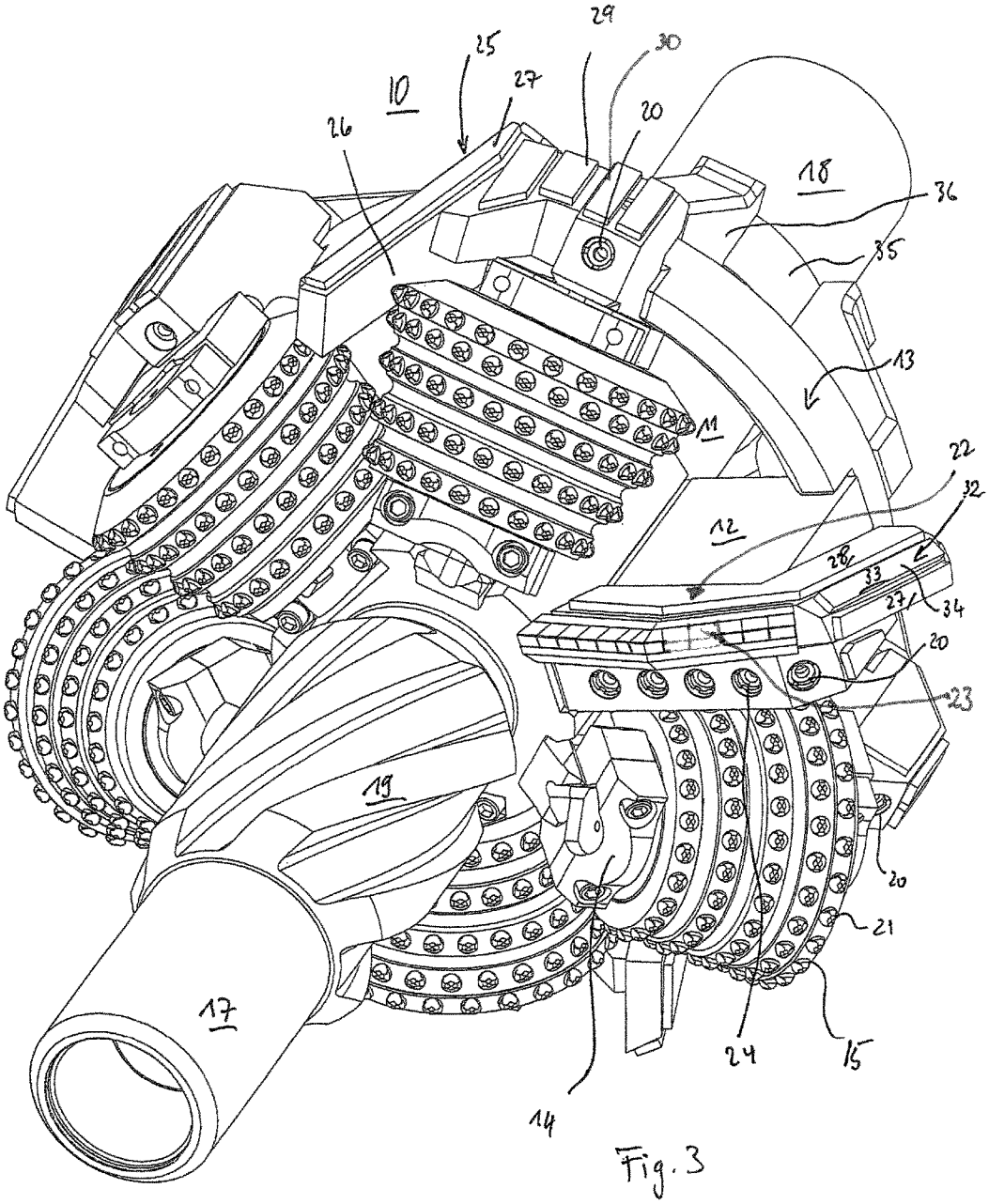
FIG. 3 shows a further three-dimensional view of the drill head according to the invention.

FIG. 1 and FIG. 2 show a borehole 100 in a soil/rock mass 101, into which, once the borehole 100 has been finished, a pipeline (not shown) is inserted. Upstream of the borehole 100 is a pilot bore 102 which has already been produced from a launch point (not shown) to a target point (not shown). As can be seen in FIG. 1, the borehole 100 comprises a working face 103 and a borehole wall 104. The working face 103 extends in a substantially right-angled manner to the pilot bore 102.

A drill head 10, an expansion drill head, is arranged in the borehole 100. The drill head 10 comprises a basic body 11 on which are arranged cross struts 12 which are connected at radial spacings to a support ring 13. The cross struts 11 are provided with tool holders 14 on which cutting rollers 15 are arranged. The cutting rollers 15 comprise teeth 16 produced from a hard metal, such as tungsten carbide, for loosening the soil, or rock 101, at the working face 103.

In addition, a first connection 17 for the drill pipes (not shown) located in the pilot borehole 102 and a second connection 18 on the rear end of the drill head 10 for the connection of the drill string (not shown) located in the borehole 100 are arranged on the basic body 11. A stabilizer 19, which comprises substantially the same diameter as the pilot borehole 102 and is situated therein, is provided on the first connection 17.

Figure 4:
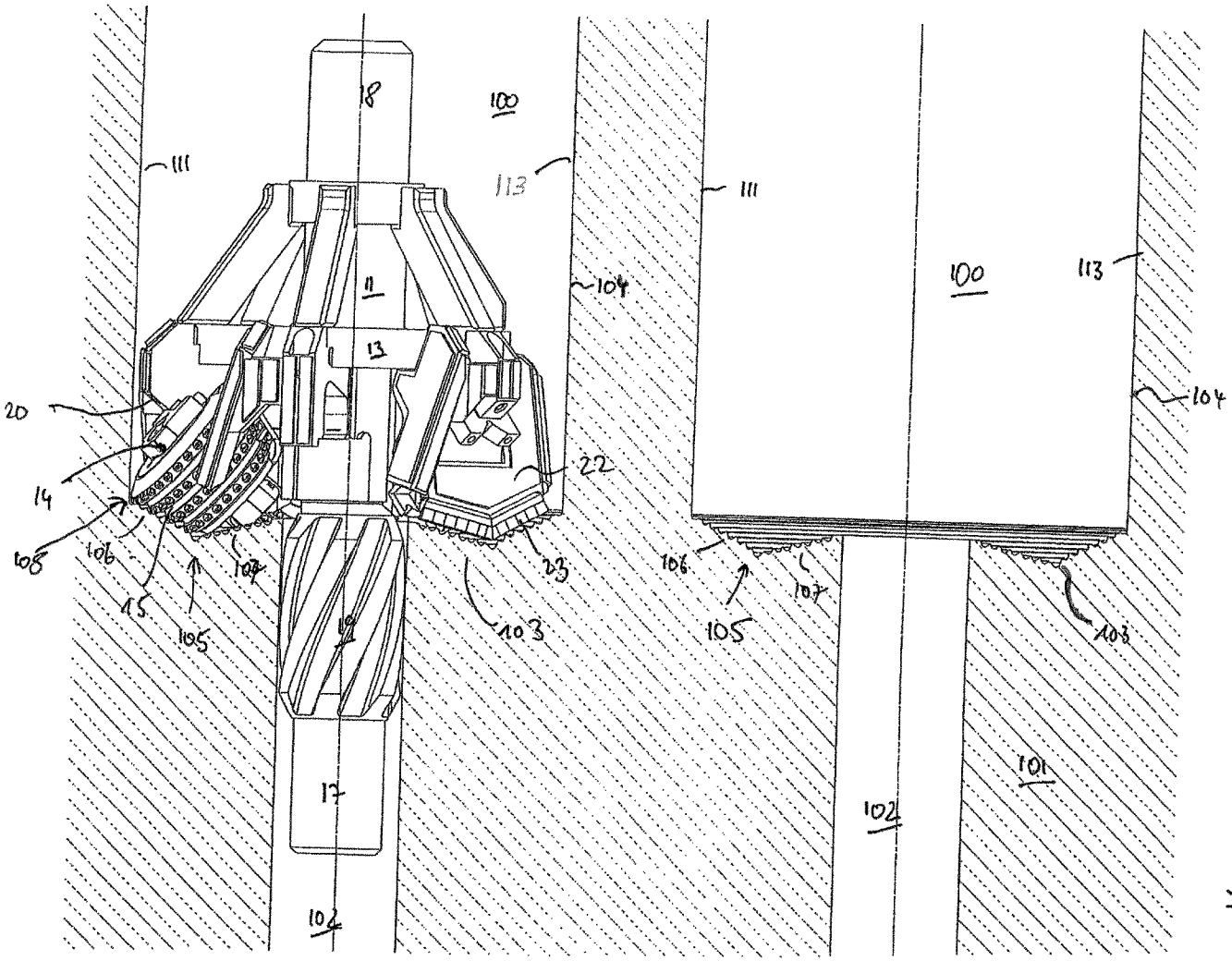
FIG. 4 shows a part-sectioned three-dimensional side view of the drill head according to the invention and a part-sectioned three-dimensional side view of the borehole produced by the drill head according to the invention.

As can be seen from the right-hand image in FIG. 4, the working face 103 comprises a V-shaped cut 105 which is provided extending radially around the pilot borehole 102. It has been proved that as a result of providing the V-shaped cut 105, the drill head 10 is particularly stabilized in relation to the borehole 100. To create the V-shaped cut 105, a certain number of tool holders 14 are aligned such that the cutting roller 15 thereof engages with the outer leg 106 of the V-shaped cut 105, which is at a further spacing radially from the pilot borehole 102, and produces the same, whilst a further number of tool holders 14 are arranged such that the cutting roller 15 thereof engages with the inner leg 107 of the V-shaped cut 105, which is at a lesser spacing radially from the pilot borehole, and produces the same. As an alternative to this and not shown here, it is also possible for the V-shaped cut 105 to be realized inversely, that is to say as a projection, projecting into the borehole 100. It is then necessary to arrange the tool holders 14 and the cutting rollers 15 arranged therein in a corresponding manner for this purpose. In the present embodiment of the drill head 10, three cutting rollers 15 are arranged such that the outer leg 106 of the working face 103 is created, whilst two cutting rollers 15 are provided for producing the inner leg 107.

Flushing nozzles 20 are provided on the tool holders, the cutting rollers 15 of which create the outside leg 106, said flushing nozzles are arranged such that they flush the gap 108 between the outer row of teeth 21 of the cutting roller 15 and the borehole wall 104 in order to avoid wear on the outer row of teeth 21 in a targeted manner. On account of the small gap width of the gap 108, drill cuttings 109 accumulate here, in particular on the bottom 113 of the borehole, and correspondingly lead to excessive wear on the outer row of teeth. This is avoided as a result of flushing the gap 108 in a targeted manner.

Figure 5:
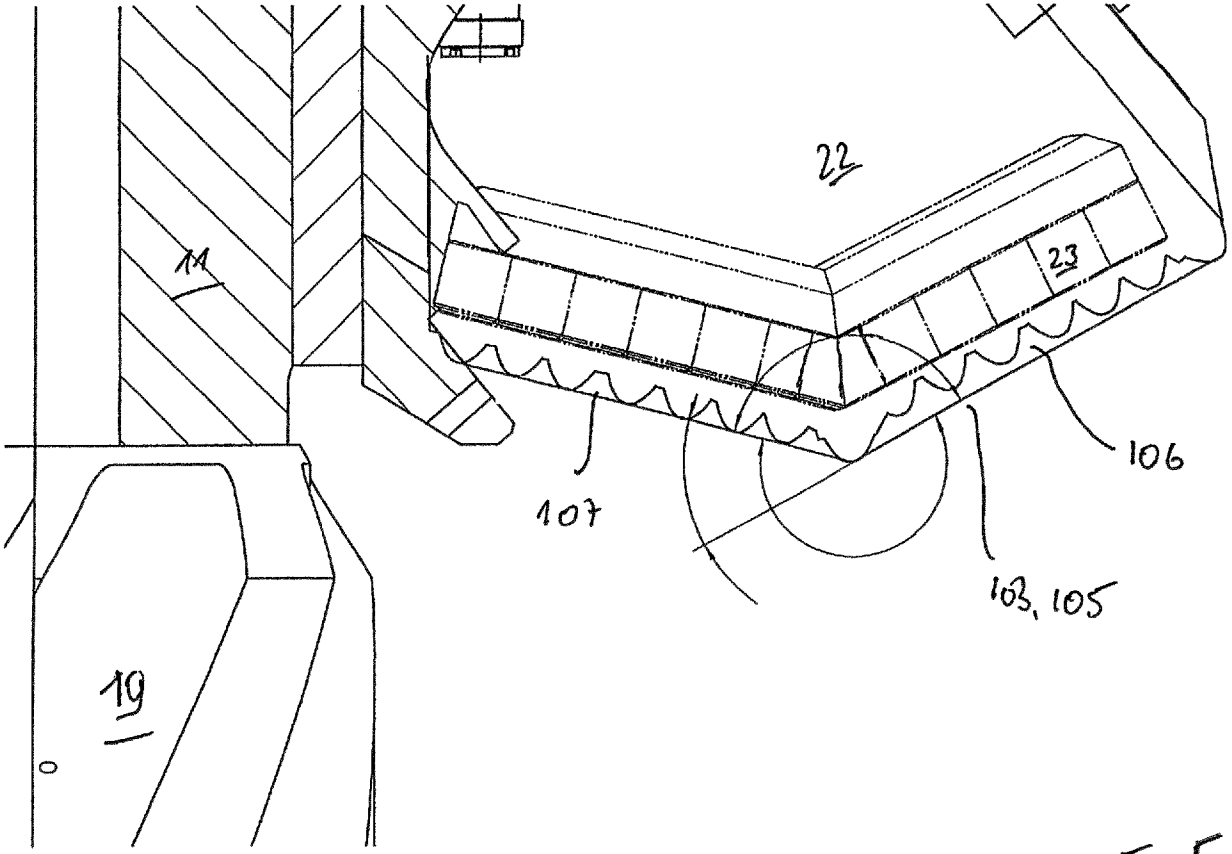
FIG. 5 shows a view of a cutout of FIG. 4 without a surrounding borehole.
Figure 7:
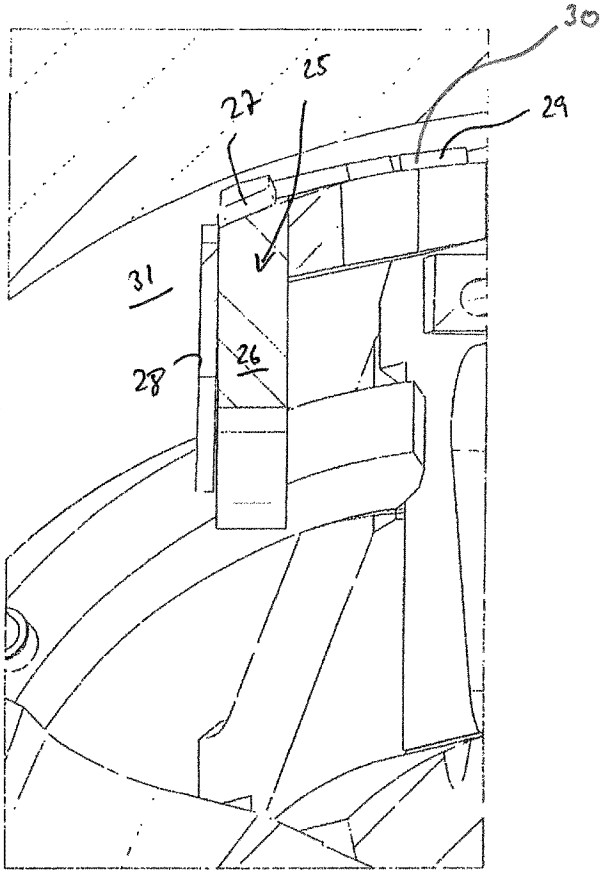
FIG. 7 shows a further partial view of the drill head according to the invention.
Figure 11:
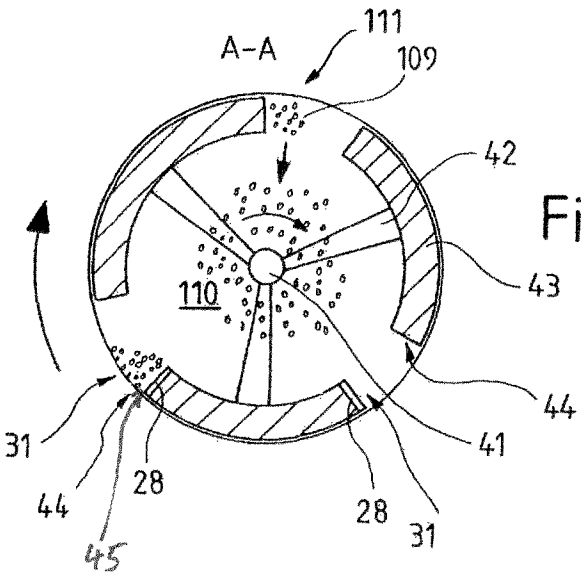
FIG. 10 shows a part-sectioned view of a stabilizer according to the invention and FIG. 11 shows a sectioned view of FIG. 10.
Figure 10:
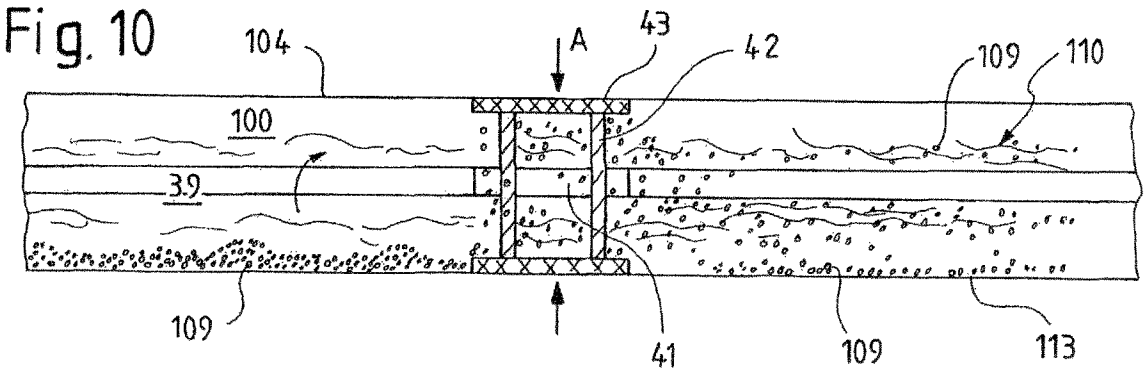

In addition, a reamer tool/receiving tool 22 is provided on a cross strut 12. The reamer tool 22 serves as receiving tool for receiving drill cuttings 109 at the working face 103. It comprises a drilling tool 23 on its front side. The drilling tool 23 comprises substantially the same form as the V-shaped cut 105 and is applied to said cut when the drill head 10 rotates. The reamer tool 22 removes the drill cuttings 109, loosened by the cutting rollers 15, out of the cutting range of the cutting rollers 15. In addition, the drilling tool 23 of the reamer tool 22 engages the working face 103 and is able to loosen and to remove loose rock located at the working face 103, or rock loosened by the cutting roller 15. Loose rock moving through the cutting rollers 15 is avoided as a result, which brings about a reduction in wear. A flushing nozzle 20 for flushing the gap 108 is also provided on the reamer tool 22. In addition, flushing nozzles 24, which flush the working face 103, or the V-shaped cut 105, are provided on the reamer tool 22. With reference to the diameter of the borehole 100, the reamer tool 22 is arranged offset at an angle in relation to said borehole. An enlarged representation of the reamer tool 22 is shown in FIG. 5. In addition, stabilizer surfaces 29, which are provided with a changeable wear plate 30, are provided on the outside surface of the cross struts 12. The stabilizer surfaces 29, as also the stabilizer 19, bring about better centering of the drill head 10 in the borehole 100, in which the stabilizer surfaces, or the wear plates 30 thereof, engage with the borehole wall 104. In addition, reamer tools 25 which comprise an elongated basic body 26 (see FIG. 7), are provided on the support ring 13. A wear plate 27 is arranged on their side facing the borehole wall 104. A wear plate 28 is arranged on the side surface of the basic body 26. The wear plates 27, 28 are realized so as to be changeable. By means of the wear plates 27, 28, the reamer tools 25 entrain drill cuttings 109, which are arranged in particular on the bottom 113 of the borehole, and convey them upward, as shown in FIG. 11, along the borehole wall 104 in the borehole 100 until the drill cuttings 109 are loosened from the entrainment region 31 in front of the wear surface 28 on account of gravity and drop down. As a result, the drill cuttings 109 pass into a flow region 110 in which a higher speed of the drill fluid predominates than in the outside regions of the borehole wall 104, as a result of which the drill cuttings 109 are entrained in the flow again, as is shown in FIG. 10.

The arrangement of the reamer tools 25 with reference to the drill head 10 is provided in this case such that the receiving surface, provided on the basic body 26 and covered with a wear plate 28, is at an angle of between 0° and 20° in relation to the alignment line of the borehole 100, as it has been shown that the drill cuttings are transported particularly well in the entrainment region 31 toward the borehole highest point 111 as a result.

Figure 6:
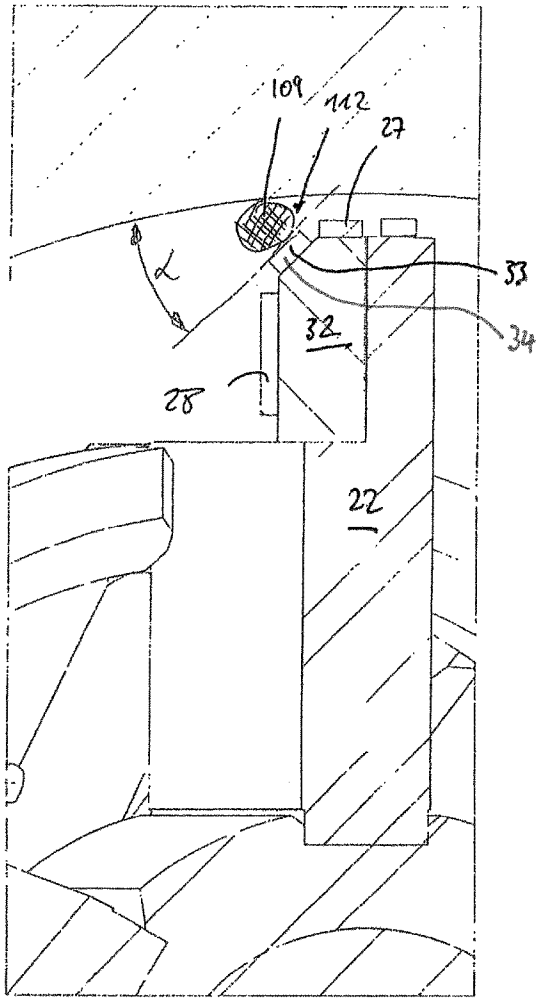
FIG. 6 shows a sectioned partial view of the drill head according to the invention.

As is shown in FIG. 6, a crushing tool 32 is provided on the reamer tool 22. This is a crushing surface 33 which is provided with a wear plate 34 which is realized so as to be changeable. The crushing surface is arranged at an angle α in relation to the borehole wall 104, as shown in FIG. 6. A crushing gap 112, in which a cuttings lump 109 which is larger than the crushing gap 112 collects and is crushed by the shear forces forming in the crushing gap 112 between the borehole wall 104 and the crushing surface 33, is formed between the crushing surface 33 and the borehole wall 104. The crushing tool 32 can also be provided on the reamer tools 25 for crushing the drill cuttings 109 in a better manner. The crushing tool 32 can be arranged in different positions on the reamer tool 22, 25 such that the adjustability of the crushing gap 112 is achievable in dependence on the desired maximum size of the drill cuttings 109.

A retaining ring 35 which is connected to the support ring 13 by means of diagonal struts 36, is arranged on the rear surface of the support ring 13. Better stability of the support ring 13 with reference to the basic body 11 is achieved as a result. Flushing nozzles 37 are provided on the rear surface of the cross struts 12 and, as a result of the additional discharging of flushing medium, these bring about a higher flow speed of the flushing medium precisely into the outside regions of the borehole 100 toward the borehole wall 104 such that better discharge of the drill cuttings 109 is ensured.

Figure 8:
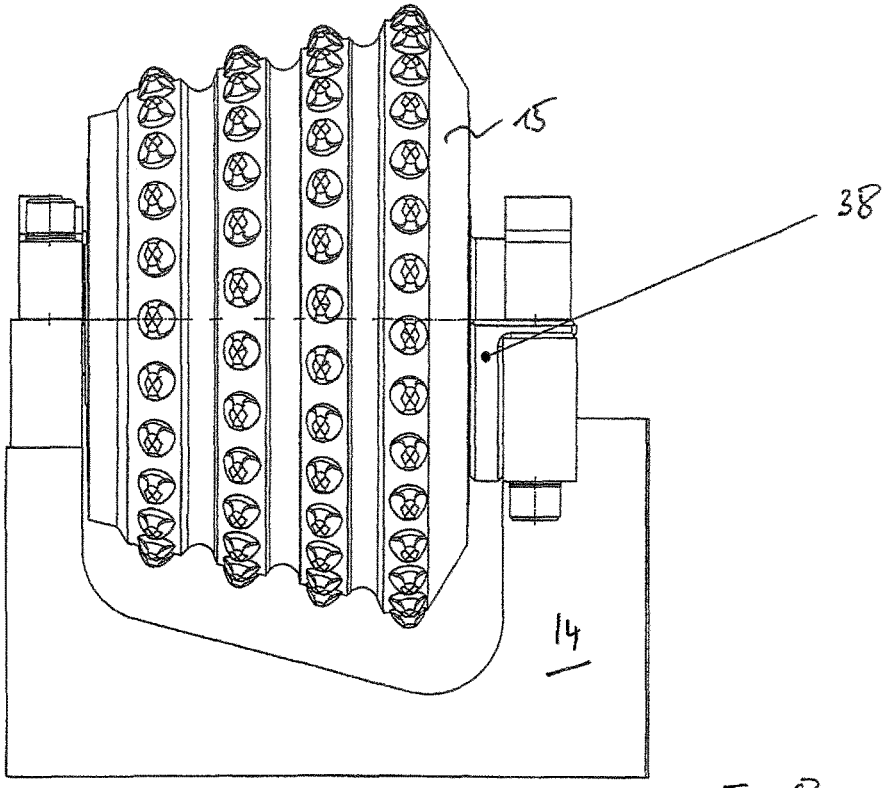
FIG. 8 shows a tool holder with a drilling tool of the drill head according to the invention in a first position.
Figure 9:
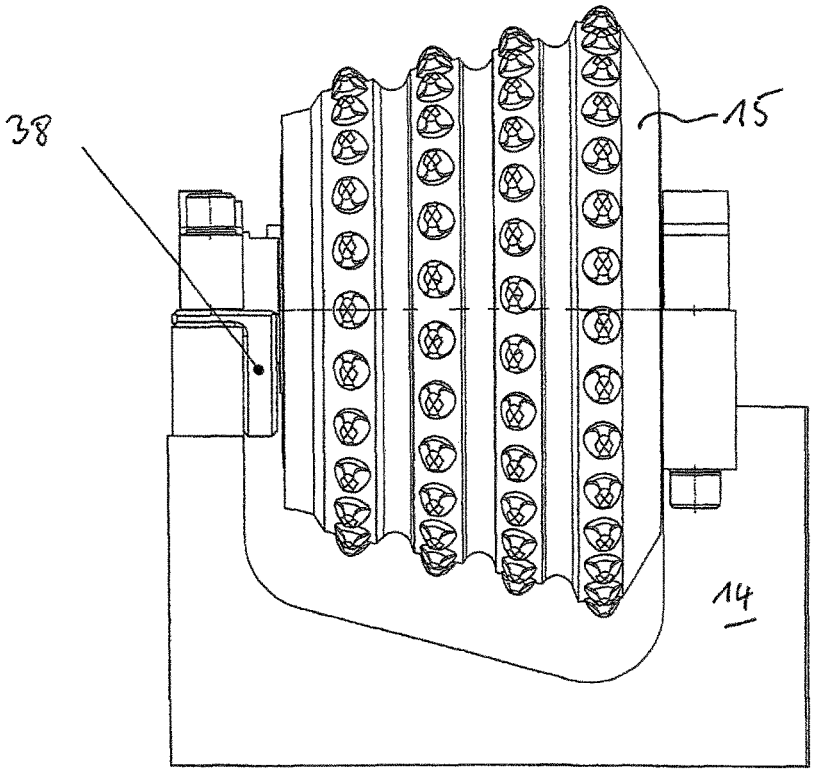
FIG. 9 shows a second position of FIG. 8.

As it has been shown that it is possible for the diameter of the borehole 100 to alter as a result of wear on the cutting rollers 15, which, once the cutting rollers 15 have been changed, causes additional overrunning of the regions with a reduced diameter by the new cutting rollers 15 when the drill head 10 is re-installed into the borehole 100 and consequently renewed wear on the outside surfaces of the cutting rollers 15, the cutting rollers 15 are displaceably arranged in the tool holder 14 so as to be radially displaceable between a first position (as shown in FIG. 8) and a second position (as shown in FIG. 9). A spacer 38, by way of which the cutting roller 15 is fixed in its respective position on the outside or inside surface of the tool holder 14, is provided in the tool holder 14 in order to fix the cutting roller 15.

In order to achieve even better centering of the drill head 10 and, over and above this, a reduction in the wear on the cutting rollers 15 when the drill head 10 is inserted and removed, or better removal of the drill cuttings 109, centering elements 40 are provided in the drill string 39 which is arranged on the connection 18 behind the drill head 10. Said centering elements comprise a basic body 41 on which cross struts 42 are arranged in the radial direction toward the borehole wall 104. Stabilizing portions 43, which cover part of the borehole wall 104, are arranged on the cross struts 42. As shown in FIG. 10, several cross struts 42 can also be provided behind one another. On one side, the stabilizing portions 48 comprise a reamer tool 44, in front of which an entrainment region 31 is formed. The reamer tool essentially comprises one receiving surface 45 which is provided with a wear plate 28. By means of the reamer tool 44, the drill cuttings 109, as shown in FIGS. 10 and 11, are entrained, conveyed to the borehole highest point 111, from where the drill cuttings 109 then fall into the flow region 110 of the drill fluid and thus are supplied again to the discharge of the drill cuttings 109 out of the borehole 100. Part of the drill cuttings 109, as shown in FIG. 10, is deposited on the bottom 113 of the borehole again. When the drill head 10 is removed, this is then also received once again and supplied to the flow region 110 again in a corresponding manner. Should it be necessary to rotate the drill head 10 and consequently also the centering element 40 in different directions, a corresponding reamer tool can be provided on both sides on the stabilizing portion 43, as shown in FIG. 11.

LIST OF REFERENCES

10 Drill head
11 Basic body
12 Cross strut
13 Support ring
14 Tool holder
15 Cutting roller
16 Tooth
17 Connection
18 Connection
19 Stabilizer
20 Flushing nozzle
21 Outer row of teeth
22 Reamer tool/receiving tool
23 Drilling tool
24 Flushing nozzle
25 Reamer tool/receiving tool
26 Basic body
27 Wear plate
28 Wear plate
29 Stabilizer surface
30 Wear plate
31 Entrainment region
32 Crushing tool
33 Crushing surface
34 Wear plate
35 Retaining ring
36 Diagonal strut
37 Flushing nozzle
38 Spacer
39 Drill string
40 Centering element
41 Basic body
42 Cross strut
43 Stabilizer portion
44 Reamer tool
45 Receiving surface
100 Borehole
101 Soil/rock
102 Pilot bore
103 Working face
104 Borehole wall
105 V-shaped cut
106 Outside leg
107 Inside leg
108 Gap
109 Drill cuttings
110 Flow region
111 Borehole highest print
112 Crushing gap
113 Borehole bottom
α Incidence angle

The invention claimed is:

1. A drill head for expanding a pilot bore in order to create a borehole having a borehole wall as a result of loosening rock surrounding the pilot bore in the region of a working face, which extends in a substantially right-angled manner to the pilot bore for HDD operation, comprising;

a basic body, with a connection element for a pilot bore string;

at least two tool holders for drilling tools, wherein at least one tool holder is on the basic body, wherein at least one tool holder is at a greater spacing radially from the basic body than the at least one other tool holder and at least one outer and one inner drilling tool are movable into engagement with the working face, and wherein the at least one inner drilling tool and the at least one outer drilling tool are each offset at an angle in relation to the working face;

at least a first receiving tool which comprises an additional drilling tool for engaging a region of the working face, wherein the receiving tool is configured to receive the drill cuttings loosened at the working face and removes them from the drilling region and stabilize the drill head from unwanted vertical movement in the horizontal bore; and at least a second receiving tool for receiving drill cuttings which are located on the bottom horizontal wall of the borehole, the receiving tool comprising a receiving surface at an angle of <20° in relation to the alignment line of the borehole.

2. The drill head as claimed in claim 1, wherein the at least two drilling tools are configured to at least one of;

create at least one radially circumferential wedge-like recess on the working face, create at least one radially circumferential wedge-like projection on the wearing face, or, have an inside angle between the drilling tools at least one of between 120° and 150°, or 135° and 140°.

3. The drill head as claimed in claim 1, comprising a flushing nozzle from which a flushing medium can be output, wherein the region between the borehole wall and the outer portion of the drilling tool pointing to the borehole wall is flushable with the output flushing medium.

4. The drill head as claimed in claim 1 comprising at least one flushing nozzle on the receiving tool.

5. The drill head as claimed in claim 1 comprising a crushing tool for crushing the drill cuttings, the crushing tool comprising a crushing surface which is movable along the borehole wall to create a crushing gap between the crushing surface and the borehole wall.

6. The drill head as claimed in claim 5 wherein at least one of the crushing gap is adjustable, the crushing surface is disposed at an angle in relation to the borehole wall, or the crushing tool is disposed on an outside surface of a receiving tool.

7. The drill head as claimed in claim 1 wherein the first receiving tool comprises on a radial outside surface at least one of a centering surface or a crushing surface.

8. The drill head as claimed in claim 1 wherein at least one tool holder is radially adjustable.

9. The drill head as claimed in claim 8 comprising spacers for the radial adjustability.

10. The drill head as claimed in claim 1 comprising at least one centering element on the side of the drill head remote from the working face.

11. The drill head as claimed in claim 1 wherein the connection element is at least one of, elongated with respect to the entry into the pilot bore, substantially the same diameter as the pilot bore stand, or comprises a centering portion with a diameter which is substantially identical to the diameter of the pilot bore.

12. The drill head as claimed in claim 1 comprising at least one stabilizing element which comprises on the stabilizing element's outside surface a contact portion, at least one of flat or with the radius of the borehole wall.

13. The drill head as claimed in claim 1 wherein at least one of the first receiving tool or the drilling tool comprises the form of the surface contour of the working face.

14. The drill head as claimed in claim 1 wherein the first receiving tool covers the drilling region of the drill head in a radial manner.

* * * * *